US007461993B1

(12) United States Patent
Sampaio

(10) Patent No.: US 7,461,993 B1
(45) Date of Patent: Dec. 9, 2008

(54) DISPENSING DISH BRUSH

(75) Inventor: Andre Sampaio, Blauvelt, NY (US)

(73) Assignee: Casabella Holdings LLC, Blauvelt, NY (US)

( * ) Notice: Subject to any disclaimer, the term of this patent is extended or adjusted under 35 U.S.C. 154(b) by 0 days.

(21) Appl. No.: 11/732,777

(22) Filed: Apr. 4, 2007

(51) Int. Cl.
*A46B 11/04* (2006.01)
*B43M 11/06* (2006.01)

(52) U.S. Cl. ..... 401/271; 401/183; 401/184; 401/278

(58) Field of Classification Search ..... 401/183–186, 401/6, 270, 276, 278, 271
See application file for complete search history.

(56) References Cited

U.S. PATENT DOCUMENTS 4,124,316 A * 11/1978 O'Rourke ..... 401/184
5,338,124 A * 8/1994 Spicer et al. ..... 401/280
5,758,984 A * 6/1998 Doherty ..... 401/184
6,364,557 B1 * 4/2002 Dougherty ..... 401/183
6,679,642 B1 * 1/2004 Dillingham et al. ..... 401/184
6,793,433 B2 * 9/2004 Giraldo ..... 401/270
7,040,830 B2 * 5/2006 Kliegman et al. ..... 401/290

* cited by examiner

*Primary Examiner*—David J Walczak
(74) *Attorney, Agent, or Firm*—Michael R. Graif; Michael J. Brown

(57) ABSTRACT

A dispensing dish brush includes a cap, a handle portion and a cleaning head. The cap and the handle portion define a common wall that defines a reservoir. The reservoir stores and dispenses a cleaning liquid. The handle portion includes a gripping portion and a neck portion. The gripping portion includes a core section, a middle section and an upper section that define a diaphragm. The neck portion has an extension portion that connects to the cleaning head. The cleaning head includes a plurality of bristles and an aperture with a wall. The aperture is placed with a removable valve and valve lock to restrict the flow of the cleaning liquid. The diaphragm is squeezable and flexes to dispense the cleaning liquid. The diaphragm accelerates the flow of the cleaning liquid in the reservoir. The cap provides access to the reservoir.

6 Claims, 9 Drawing Sheets

DISPENSING DISH BRUSH

BACKGROUND

1. Field of the Invention

The present invention relates to hand held cleaning implements and more particularly to a hand held dispensing dish brush that dispenses a liquid.

2. Description of the Related Art

Hand held dispensing dish brushes are commonly used with a separate bottle of cleaning liquid. The cleaning liquid is applied to an area and then the hand held cleaning implement or brush is used to scrub that area. This process can be frustrating when the cleaning liquid runs or drips off an inclined area that needs to be cleaned. In this all too common situation, the cleaning liquid does not get adequately absorbed into the area and excessive force needs to be applied by the dispensing dish brush to clean the area.

A hand held cleaning implement is needed that has an integral ability to dispense a cleaning liquid to an area and simultaneously scrub that same area. A cleaning implement is further needed that has an enhanced ability to dispense the cleaning liquid with a high velocity while scrubbing.

SUMMARY OF THE INVENTION

A dispensing dish brush is described that comprises a cleaning head, a handle and a neck. The cleaning head has a face that includes a plurality of bristles and one or more apertures. The cleaning head has a wall that defines a first portion of a reservoir. The handle has a flexible wall that defines a second portion of the reservoir. A diaphragm is connected to the inner side of the wall of the handle. The neck connects the handle and the cleaning head. The neck has a wall that defines a third portion of the reservoir. The first portion of the reservoir, the second portion the reservoir, the third portion of the reservoir and the apertures are in fluid communication.

A first position of the dispensing dish brush wherein the handle defines a first distance between the diaphragm and an opposing wall of the handle and a second position of the dispensing dish brush wherein the handle is flexed. When the handle is flexed the distance between the diaphragm and the opposing wall is a second distance that is less than the first distance.

The reservoir stores and dispenses a liquid. The interior surfaces of the wall of the handle, neck and cleaning head have a smooth surface to promote a laminar flow in the reservoir. The handle has a flexible structure to control the rate of flow of the cleaning liquid from the reservoir. The reservoir includes a liquid and as the wall of the handle flexes due to an external force to the second position, the liquid accelerates over the diaphragm. The cleaning head has a face that is approximately transverse to the central longitudinal axis. The apertures are constricted by a bias member that seals the apertures from the gravity flow of the liquid and the bias member flexes to open under a predetermined amount of pressure from the reservoir.

BRIEF DESCRIPTION OF THE DRAWINGS

The above mentioned and other features, aspects and advantages of the present invention will become better understood with regard to the following description, appended claims and accompanying drawings, wherein like reference numerals refer to similar parts throughout the several views where:

DESCRIPTION OF THE PREFERRED EMBODIMENT OF THE INVENTION

Figure 1:
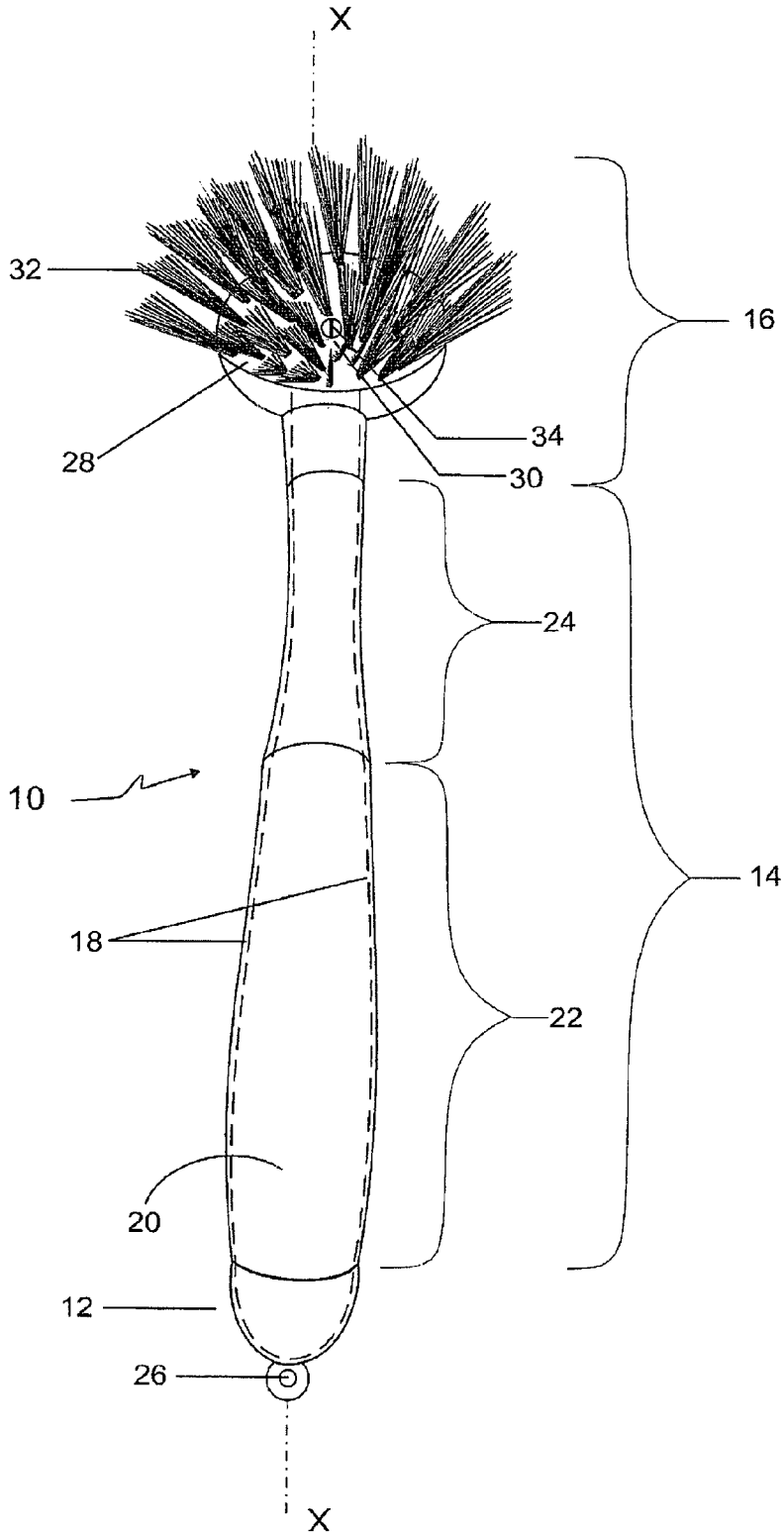
FIG. 1 is a bottom view of a dispensing dish brush in a first position of a diaphragm constructed in accordance with the present invention.

Although specific terms are used in the following description for sake of clarity, these terms are intended to refer only to particular structures of the invention selected for illustration in the drawings, and are not intended to define or limit the scope of the invention.

Referring now to FIG. 1, a dispensing dish brush 10 includes a cap 12, a handle portion 14 and a cleaning head 16. Brush 10 has a proximal end portion and a distal end portion that define a central longitudinal axis-X. The proximal end portion of brush 10 includes cap 12 and the distal end portion of brush 10 includes cleaning head 16. Cap 12 and handle portion 14 have walls 18 that define a reservoir 20 for the storage and dispensing of a cleaning liquid.

Handle portion 14 includes a gripping portion 22 and a neck portion 24. Gripping portion 22 and neck portion 24 are approximately cylindrical tubes. Gripping portion 22 and neck portion 24 taper the interior dimensions of reservoir 20 in the distal direction. The length of gripping portion 22 is approximately 66 percent of a length of handle portion 14. The length of neck portion 24 is approximately 33 percent of a length of handle portion 14. In this one preferred embodiment, handle portion 14 is preferably made of a material that has increased structural flexibility relative to cap 12 and cleaning head 16.

Cap 12 provides an access to reservoir 20. The length of cap 12 is approximately 10 percent of a length of handle portion 14. Cap 12 forms a fluid tight seal with the proximal end of handle 12. In this embodiment, wall 18 of cap 12 defines a fraction of reservoir 20 that stores the cleaning liquid. Cap 12 preferably includes a through hole 26 that is approximately transverse to the central longitudinal axis-X. Through hole 26 is approximately 50 percent of a length of cap 12. Cap 12 in this one preferred embodiment is preferably made of a polymer material that has increased structural integrity or rigidity relative to handle portion 14.

Cleaning head 16 defines a face 28 that includes an aperture 30 and a plurality of bristles 32. Face 28 is preferably angled transverse to the central longitudinal axis-X. Aperture 30 in this one preferred embodiment has a diameter that is approximately one-tenth of a diameter of cleaning head 16, but it is understood that the diameters of aperture 30 and cleaning head 16 can vary with the intended use of brush 10. In this preferred embodiment, cleaning head 16 is preferably made of a polymer material that has increased structural rigidity relative to handle portion 14. Aperture 30 of cleaning head 16 includes a wall 34 that preferably divides aperture 30 into two semi-circular sections. Wall 34 is positioned approximately parallel to the central longitudinal axis-X and has a length that is approximately equal to the diameter of aperture 30. It is understood, however, that aperture 30 can include a plurality of walls 34 to divide aperture 30 into quadrants. Aperture 30 is in fluid communication with reservoir 20.

Bristles 32 are preferably in sets or groupings that are positioned in separate and fixed spaced relation on face 28. Bristles 32 project in an approximately perpendicular and in an outward direction from face 28. Bristles 32 are preferably made of a polymer material such as nylon, but bristles 32 can be made of any suitable material for scrubbing any desired surface to include metals, composites and plant products.

Figure 2:
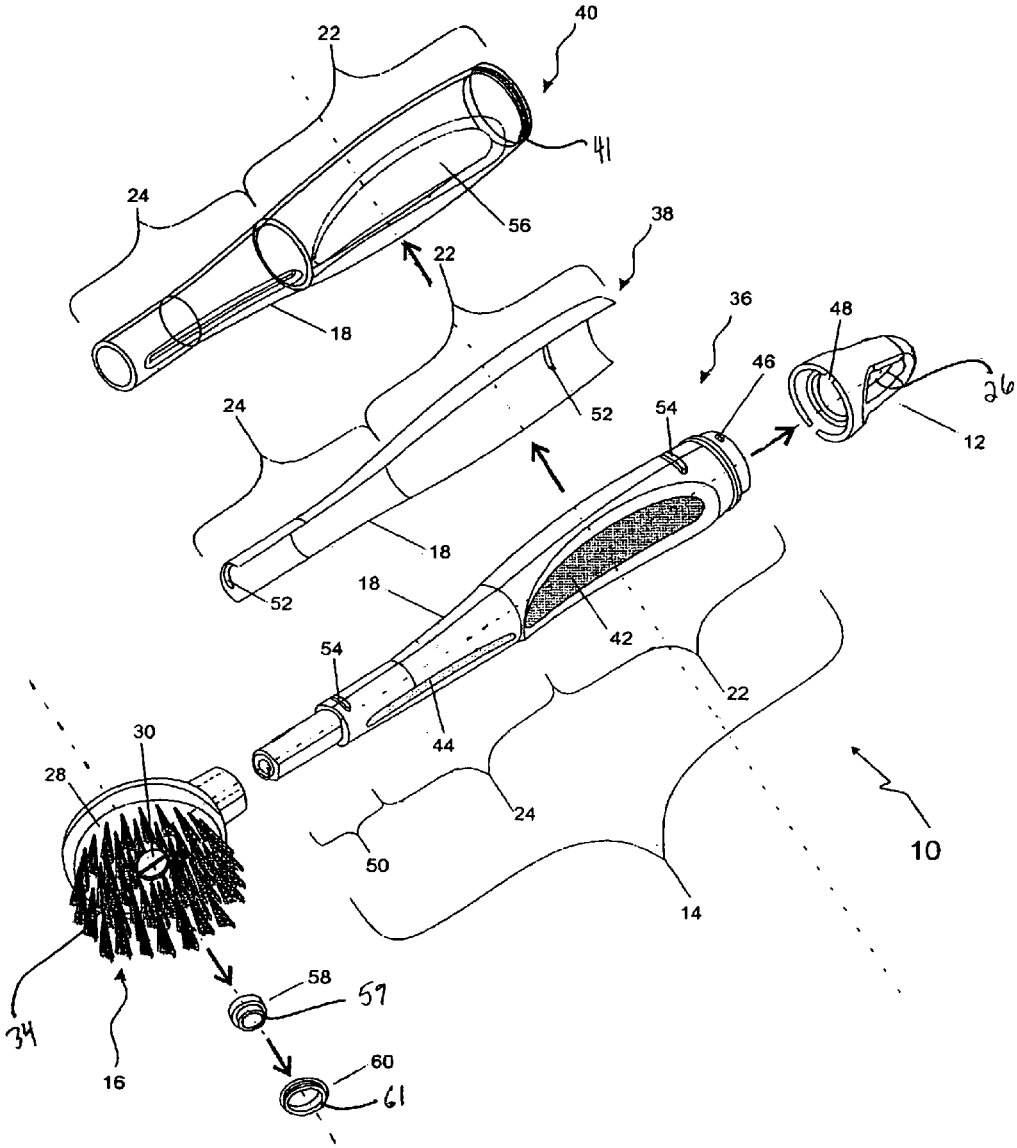
FIG. 2 is a side perspective exploded view of the dispensing dish brush of FIG. 1.

Referring to FIG. 2, handle portion 14 includes a core section 36, a middle section 38 and an upper section 40. Middle section 38 preferably connects to core section 36 and upper section 40 preferably connects to middle section 38 and encloses both core section 36 and middle section 38. Core section 36, middle section 38 and upper section 40 are preferably concentric with their common center lying on the central longitudinal axis-X.

Core section 36 is a cylindrical tube that includes a first cut 42 in gripping portion 22. First cut 42 is approximately of concave shape and has a length that preferably extends along the central longitudinal axis-X. The length of first cut 42 is approximately about 90 percent of a length of gripping portion 22. First cut 42 has a depth that is approximately one-third of the length of first cut 42. The depth of first cut 42 preferably extends in a plane that is approximately transverse to the central longitudinal axis-X.

Core section 36 includes a pair of second cuts 44 in neck portion 24. Second cuts 44 are positioned on two diametrically opposite sides of wall 18 of neck portion 24. Each second cut 44 has a length that preferably extends along the central longitudinal axis-X. The length of second cut 44 is approximately about 90 percent of a length of gripping portion 22.

Core section 36 has a proximal end that includes a pair of first protrusions 46. First protrusions 46 preferably have a snap-fit connection with a pair of grooves 48 defined by cap 12. The snap-fit connection preferably seals the proximal end of handle portion 14 with cap 12. Core section 36 includes an extension portion 50 that preferably extends into cleaning head 16 and terminates at face 28. Cleaning liquid is dispensed through extension portion 50 into cleaning head 16. The extension portion 50 has a length that is approximately one-seventh of the total length of core section 36, and has a diameter that is approximately one-half the diameter of the distal end of neck portion 24. It is understood, however, that the dimensions of first cut 42, second cut 44 and extension portion 50 can vary as per the intended use of brush 10. The core section 36 is preferably made of rigid and resilient material that has a low coefficient of friction. In this preferred embodiment, core section 36 is preferably made of composites of polyamide and polystyrene such as nylon, for example.

Middle section 38 is a cylindrical tube that has a semi-circular cross section. Middle section 38 has an inner diameter that is approximately equal to an outer diameter of core section 36. The middle section 38 in this one preferred embodiment is preferably made of hard and sturdy material such as composites of stainless steel, for example. Middle section 38 preferably partially encloses wall 18 that is approximately opposite to first cut 42.

Upper section 40 is a cylindrical tube that preferably encloses core section 36 and middle section 38. Upper section has an inner diameter that is approximately equal to an outer diameter of the middle section 38. Upper section 40 has a length that preferably accommodates core section 36 and middle section 38 excluding the extension portion 50. In the assembled condition of handle portion 14, wall 18 of upper portion 40 preferably fits over the first cut 42 and acts as a diaphragm 56. The upper section 40 in this one preferred embodiment is preferably made of flexible, transparent and resilient polymer or rubber material. Upper section 40 has a proximal end that includes a threaded end 41 for fastening cap 12 preferably by screwing cap 12 onto upper section 40.

Again Referring to FIG. 2, cleaning head 16 includes a valve 58 and a valve lock 60. Valve 58 has a diameter that is approximately equal to the diameter of aperture 30. Valve 58 preferably fits over aperture 30 and wall 34. Valve lock 60 is an annular ring member that locks valve 58 with aperture 30 by insertion into lip 59 of valve 58. Valve lock 60 includes a rim 61 from which the cleaning liquid is finally dispensed around valve 58. When the cleaning liquid is under pressure, such pressure forces the cleaning liquid against valve 58 and dislodges valve 58 to allow the cleaning liquid to pass between valve 58 and valve lock rim 61. Valve 58 and valve lock 60 can withstand the hydraulic pressure being applied by the cleaning liquid without being ruptured. In this one preferred embodiment, valve 58 is preferably made of flexible and resilient polymer or rubber material and valve lock 60 is preferably made of stainless steel.

Figure 3:
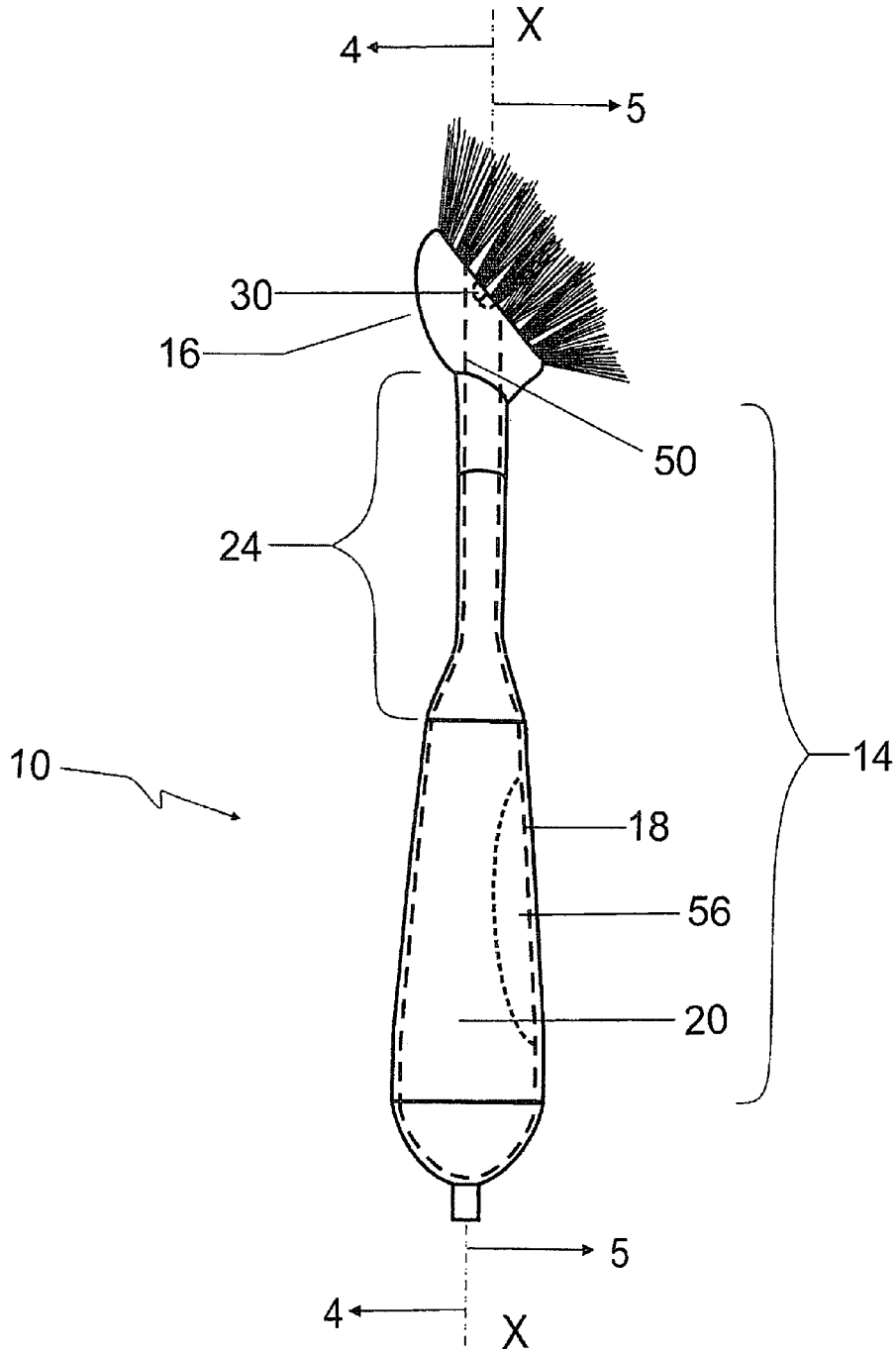
FIG. 3 is a right side view of the dispensing dish brush of FIG. 1.
Figure 4:
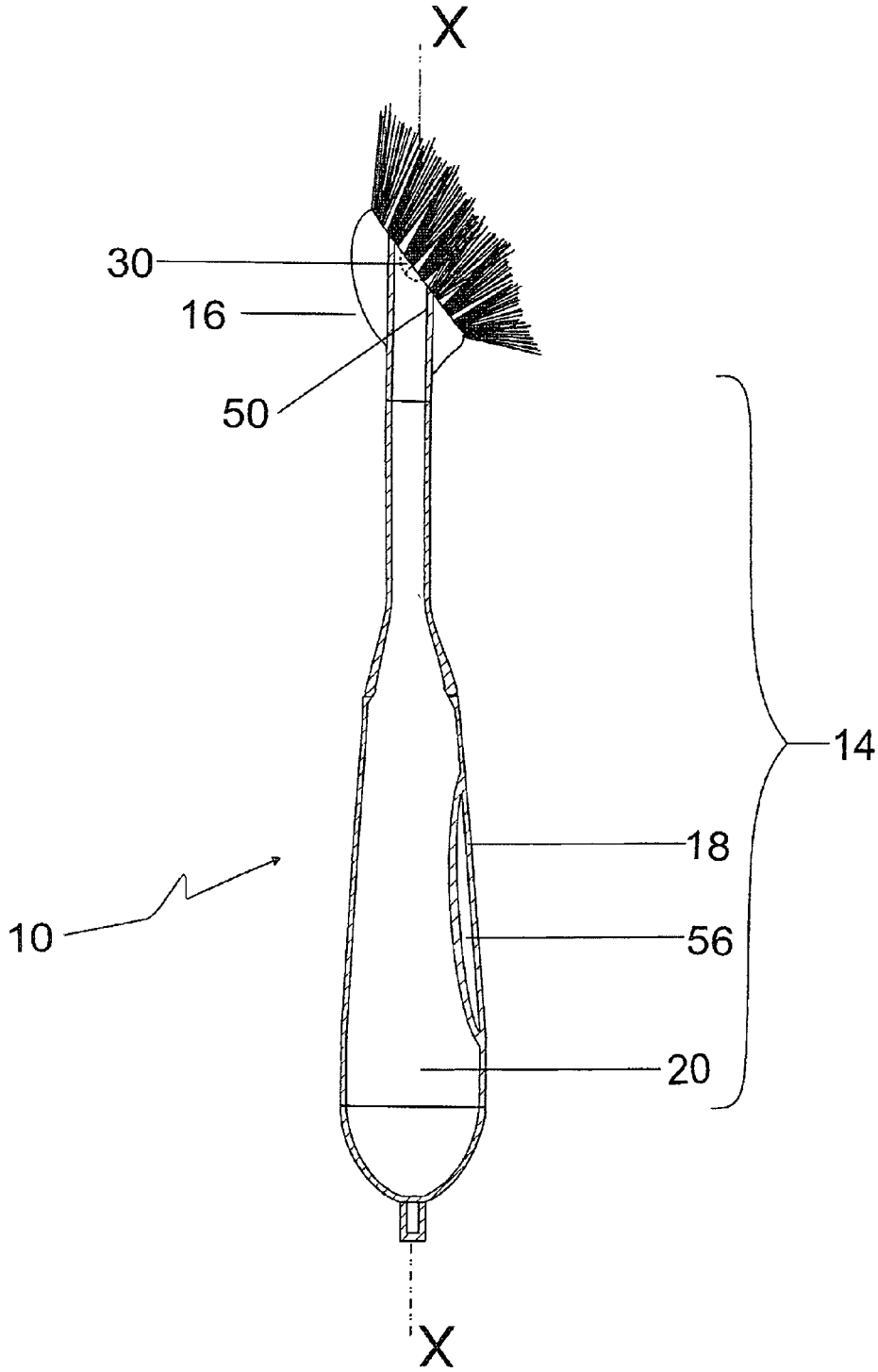
FIG. 4 is a side cross-sectional view taken along lines 4-4 of the dispensing dish brush of FIG. 3 in an emptied condition.

As shown in FIGS. 3 and 4, Brush 10 is shown in a first position with diaphragm 56 in an unflexed or undeformed state. Diaphragm 56 is preferably monolithically formed as part of handle portion 14 in this embodiment. Diaphragm 56 is in direct communication with the cleaning liquid in reservoir 20. Diaphragm 56 is preferably on the wall 18 opposite of a portion of handle portion 14 that is configured for gripping by a user. Diaphragm 56 and interior of walls 18 preferably have a smooth inner surface.

The extension portion 50 of handle portion 14 defines a distal terminal end of reservoir 20. Extension portion 50 has a diameter that is approximately twice the diameter of aperture 30. Extension portion 50 preferably completely encloses aperture 30.

Figure 5:
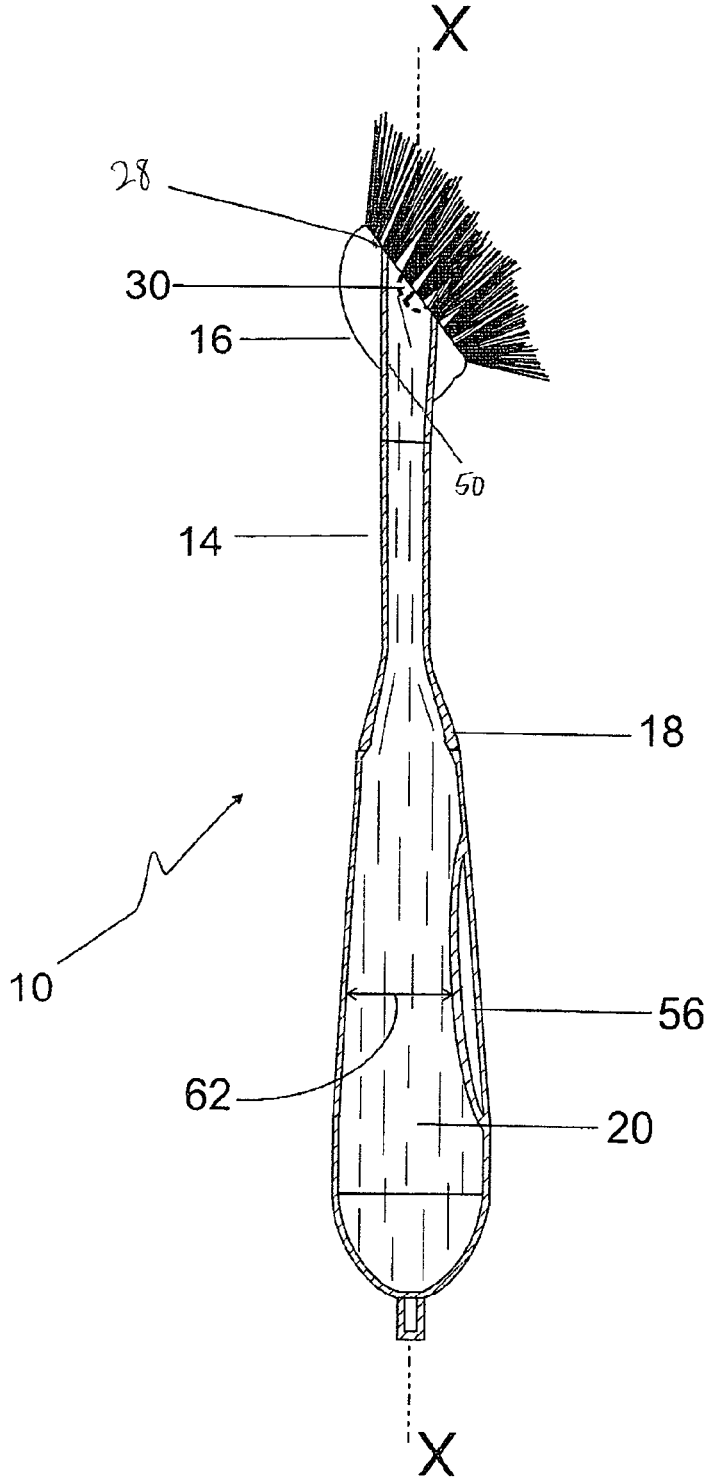
FIG. 5 is a side cross-sectional view taken along lines 5-5 of the dispensing dish brush of FIG. 3 in a filled condition.

Referring to FIG. 5, brush 10 has the cleaning liquid in reservoir 20 and is in a first position with diaphragm 56 unflexed or undeformed by an external force. In this position, the angular position of brush 10 and extension portion 50 can cause gravity flow of the cleaning liquid towards the face 28. In this position, diaphragm 56 and opposite wall 18 of diaphragm 56 define a first distance 62.

Figure 6:
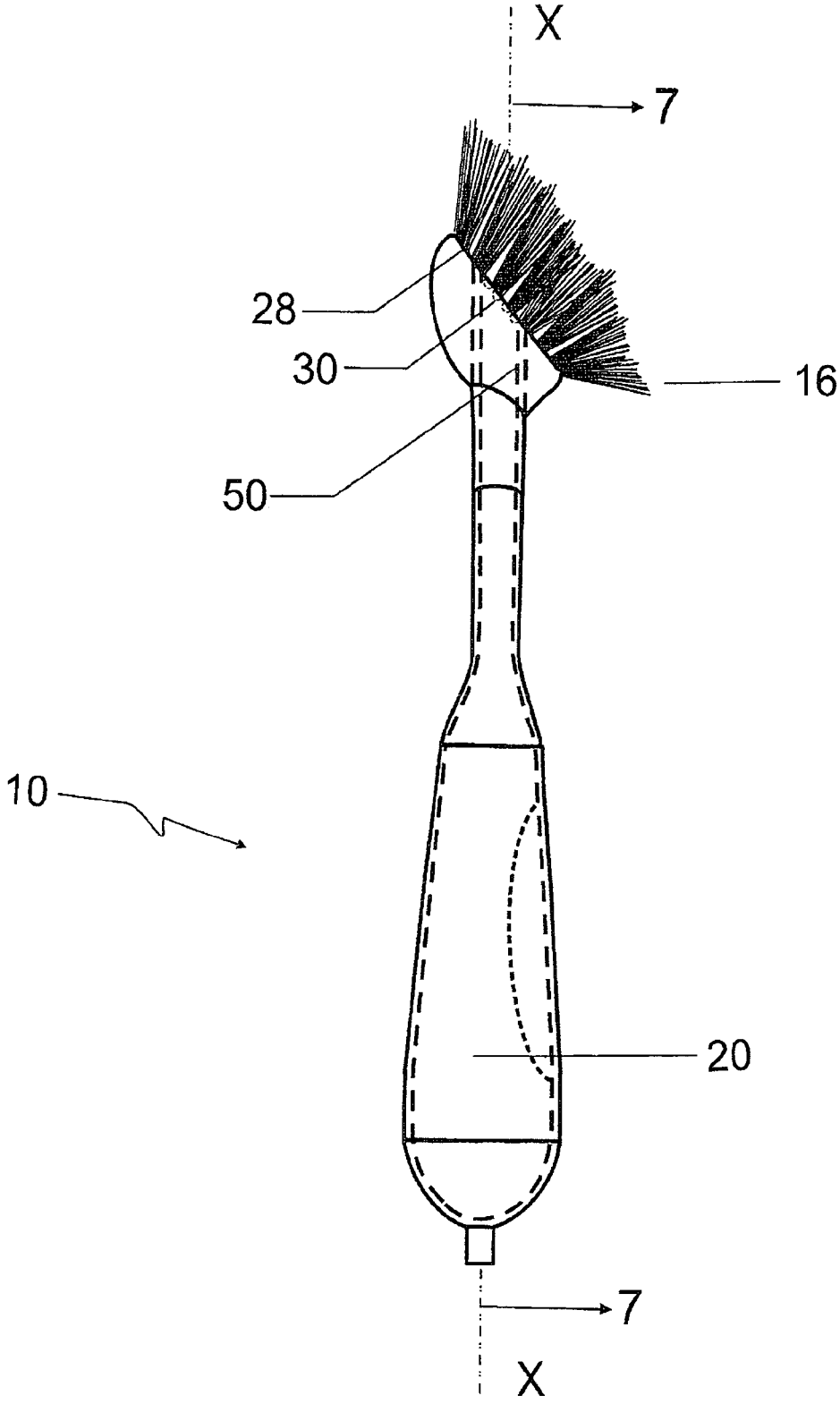
FIG. 6 is a right side view of an alternative embodiment of a cleaning head of the dispensing dish brush of FIG. 1.
Figure 7:
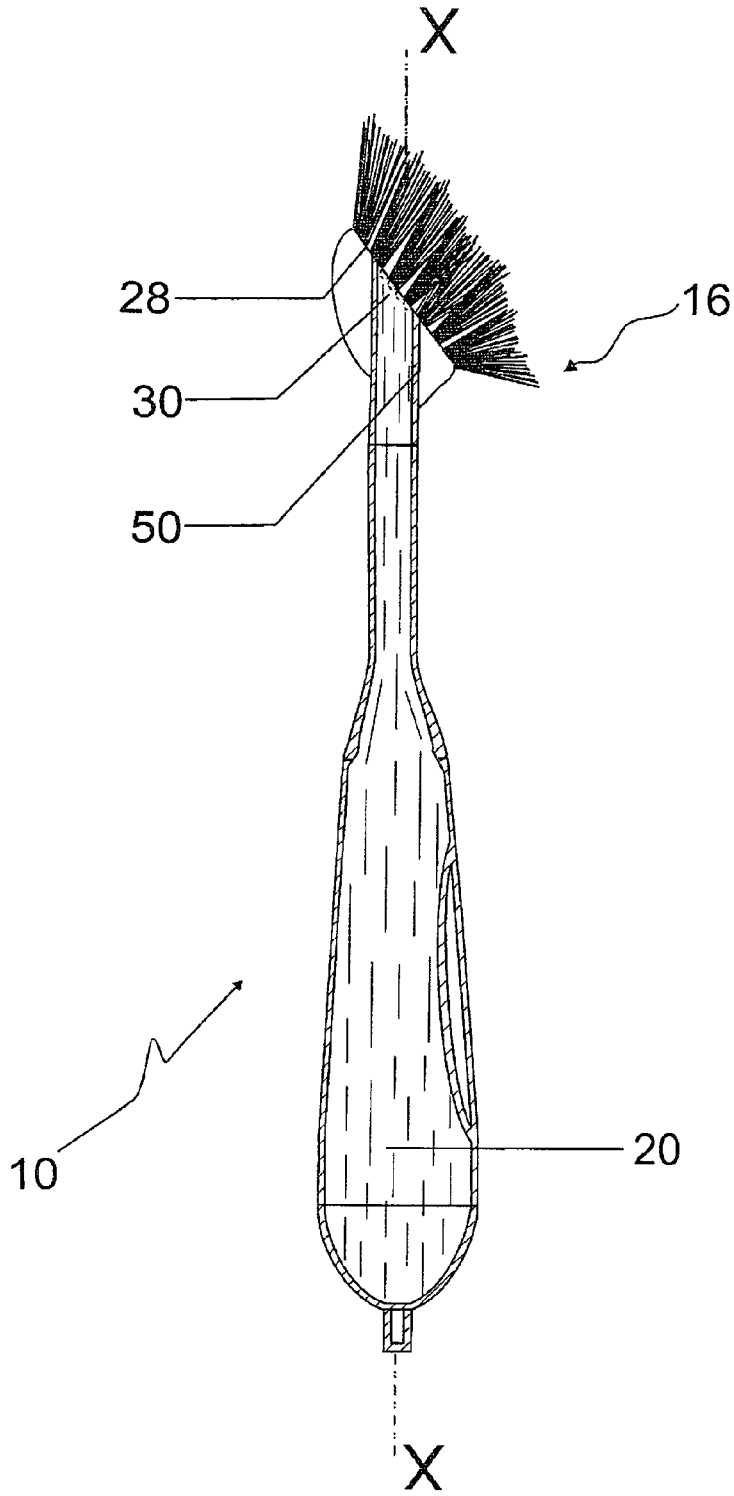
FIG. 7 is a side cross-sectional view taken along lines 7-7 of the dispensing dish brush of FIG. 6.

Referring to FIGS. 6 and 7, an alternative embodiment of cleaning head 16 is shown. Cleaning head 16 in this one alternative embodiment includes a plurality of apertures 30 in face 28. Apertures 30 are in fluid communication with reservoir 20. Apertures 30 are preferably positioned in a concentric circular configuration within an area defined by extension portion 50.

Figure 8:
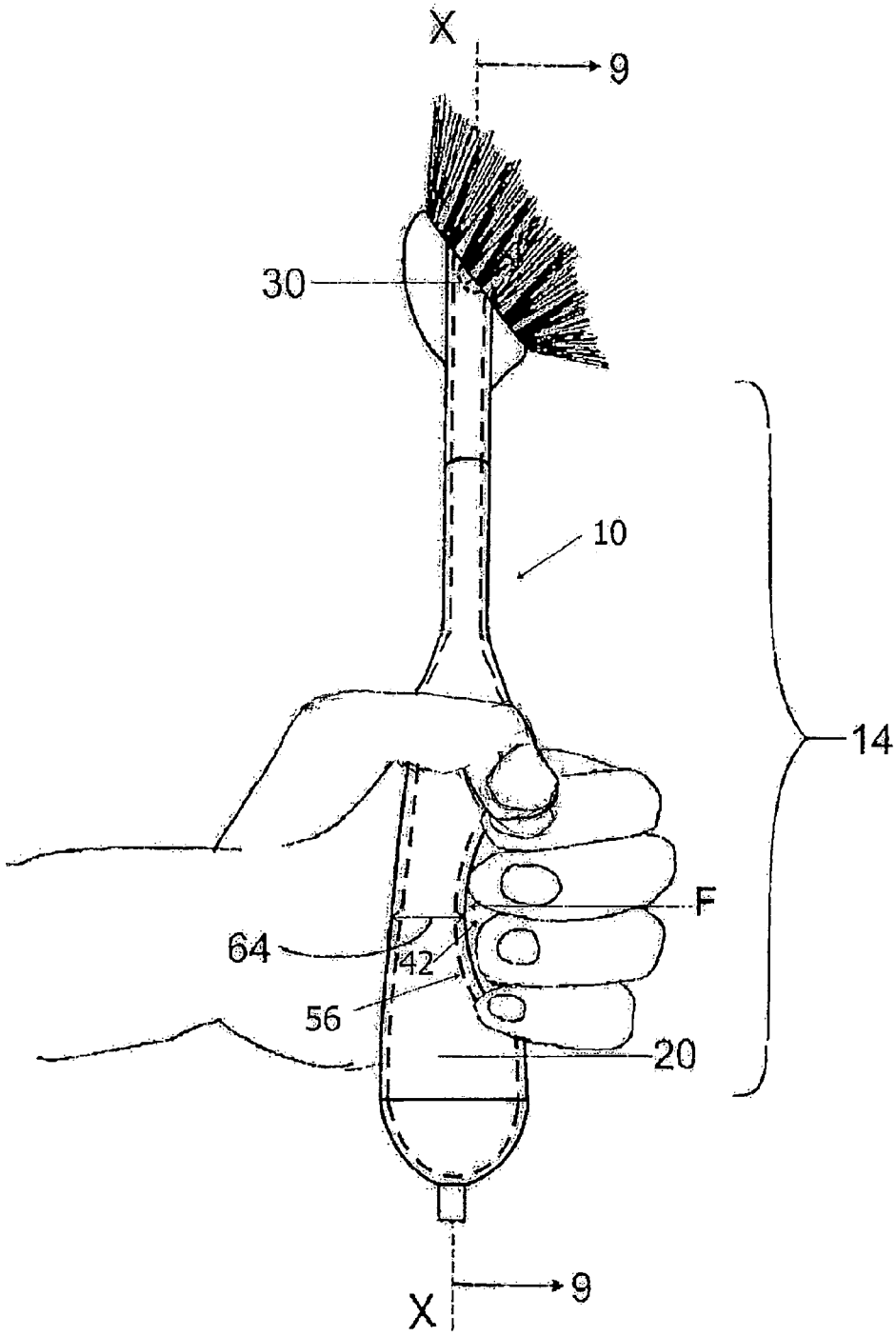
FIG. 8 is a right side view of the dispensing dish brush of FIG. 1 in a second position of the diaphragm as depressed by a hand.
Figure 9:
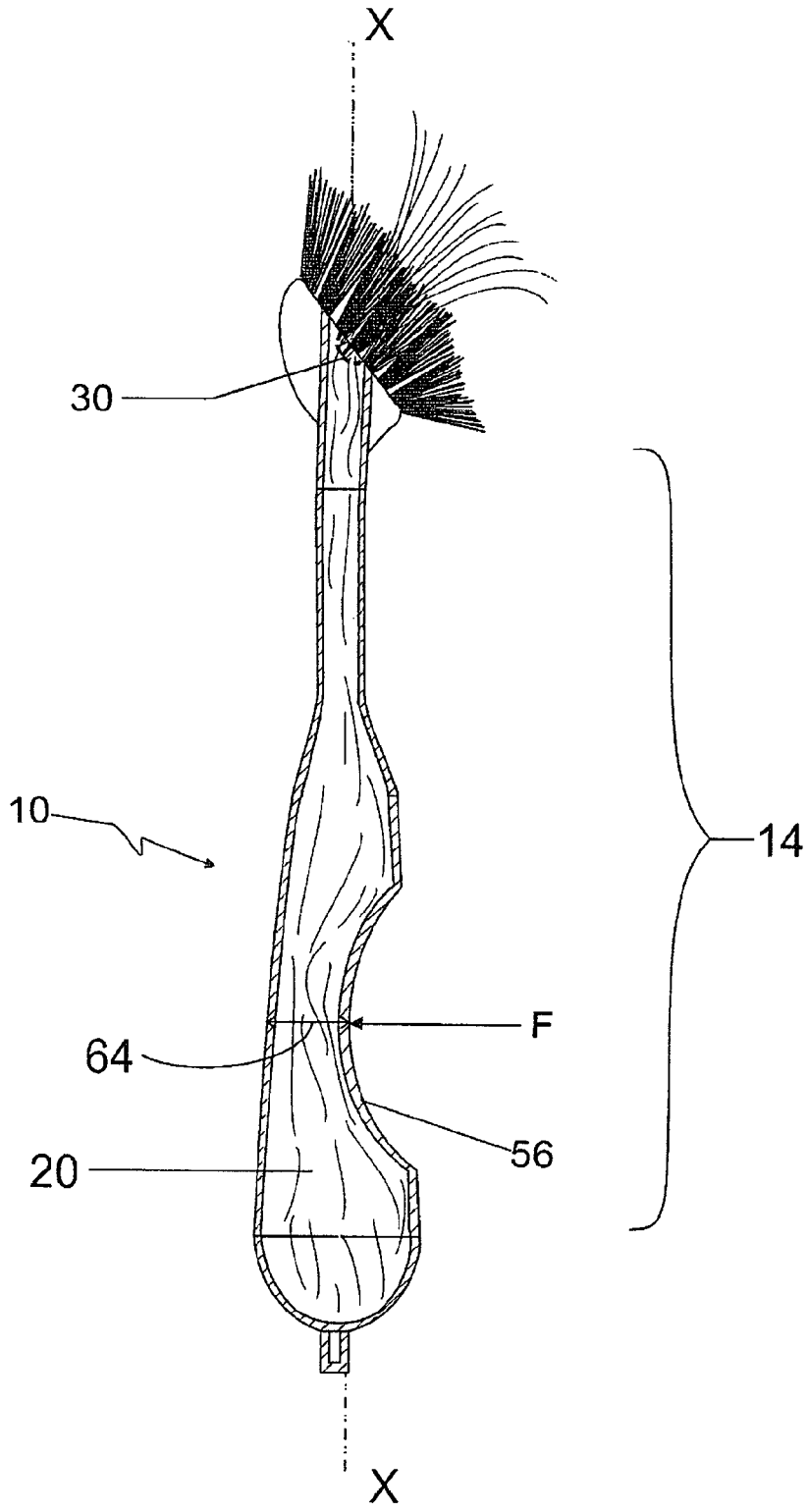
FIG. 9 is a side cross-sectional view taken along lines 9-9 of the dispensing dish brush of FIG. 8.

Referring to FIGS. 8 and 9, brush 10 is in a second position after receiving a directed force preferably generated by a hand as shown by an arrow F on handle portion 14. Force-F can be from single direction shown as well as one or more alternative directions. For example, a force is typically applied on the diaphragm 56 of handle portion 14. In this second position, diaphragm 56 deforms to compress the volume in reservoir 20 and force the cleaning liquid through aperture 30 as a single stream. In this position, diaphragm 56 and wall 18 opposite to diaphragm 56 define a second distance 64 that is less than first distance 62.

As shown in FIGS. 1-9, dispensing dish brush 10 in operation is advantageously used for scrubbing a broad range of surfaces such as, for example, tiles, the grout between tiles, floor stains, tubs and washbasins.

The flexible structure of handle portion 14 advantageously allows the user to control the rate of flow of the cleaning liquid from reservoir 20 through aperture 30. The smooth inner surface of handle portion 14 promotes a laminar flow in reservoir 20.

Diaphragm 56 advantageously allows the user to increase the velocity of the cleaning liquid within the reservoir 20 by creating a Venturi effect between diaphragm 56 and the opposing wall 18 of handle portion 14, when diaphragm 56 receives an externally directed force. Gripping portion 22 and/or wall 18 over second cut 44 have a tapered structure that allows the user to increase the velocity of the cleaning liquid towards the cleaning head 16.

The extension portion 50 of handle portion 14 instantly supplies the cleaning liquid at aperture 30 that advantageously allows the user to apply less external force on diaphragm 56. Core section 36 is made of a material that has a sufficiently low coefficient of friction that facilitates a frictionless flow of the cleaning liquid in reservoir 20. The tough and sturdy construction of middle section 38 advantageously facilitates a firm grip to brush 10. The transparent construction of upper section 40 of handle portion 14 advantageously gives an aesthetic look to brush 10 and also allows the user to view the amount of the cleaning liquid remaining in the reservoir 20.

The relative rigidity of neck portion 24 allows the user to apply potentially high force on the head 16 that improves the scrubbing operation with brush 10. The relative rigidity of neck portion 24 advantageously facilitates a directional control for the angular orientation of cleaning head 16.

Cap 12 provides an access to reservoir 20 for the refilling or draining of cleaning liquid from brush 10. Through hole 26 provides a loop that can be used to hang the dispensing dish brush 10 from a hook. Cap 12 provides a secure snap-fit connection with wall 18 that can withstand the internal pressure created during the application of external force such as that of force-F.

The inclined face 28 of the cleaning head 16 allows aperture 30 to be directed at hard to reach angles that are common to many bathroom fixtures such as tubs, sinks and toilets. Aperture 30 ejects a high velocity single stream of the cleaning liquid to readily loosen the stains and the soil. This advantageously allows the user to put fewer efforts for the actual scrubbing operation. While scrubbing, the conical shape of the bristles 32 advantageously allows brush 10 to easily reach and clean the hard to reach regions such as, for example, grouts between tiles and the inner curved surfaces of the tubs and washbasins. When brush 10 is not in use, Valve 58 and valve lock 60 are advantageously used to prevent the flow of the cleaning liquid from aperture 30.

What is claimed is:

1. A dispensing dish brush that comprises:

a cleaning head that includes a face, the face comprises a plurality of bristles and an aperture, the aperture has a wall that divides the aperture into two semi-circular sections, the aperture adapted to dispense a cleaning fluid as a single stream, the cleaning head includes a valve and a valve lock that are adapted to restrict the flow of the cleaning liquid from the aperture;

a handle portion that includes a gripping portion and a neck portion, the gripping portion comprises a core section, a middle section and an upper section that are adapted to define a reservoir and a diaphragm, the diaphragm adapted to increase the velocity of the cleaning liquid, the reservoir adapted to store and dispense the cleaning liquid, the neck portion connects to the face of the cleaning head to provide an instant flow of the cleaning liquid at the aperture;

a cap that includes a through hole to hang the brush from a hook, the cap has a wall that defines a fraction of the reservoir that stores the cleaning liquid, the cap provides an access to the reservoir for the refilling or draining of the cleaning liquid from the brush;

a first position wherein the handle portion defines a first distance between the diaphragm and an opposing wall of the handle portion; and a second position wherein the handle portion is flexed and the distance between the diaphragm and the opposing wall is a second distance, whereby the second distance is less than the first distance.

2. The dispensing dish brush of claim 1, wherein the core section is made of a material that has a low coefficient of friction that promotes a frictionless laminar flow in the reservoir.

3. The dispensing dish brush of claim 1, wherein the handle portion may be flexed to control the rate of flow of the cleaning liquid from the reservoir.

4. The dispensing dish brush as claimed in claim 1, wherein the reservoir includes a liquid and that accelerates over the diaphragm as the diaphragm flexes to the second position.

5. The dispensing dish brush as claimed in claim 1, wherein the face of the cleaning head is approximately transverse to a central longitudinal axis of the handle portion.

6. The dispensing dish brush as claimed in claim 1, wherein the neck portion has a structural rigidity relative to handle to provide directional control for the angular orientation of the cleaning head.

* * * * *